US008317267B2

(12) United States Patent
Wallace

(10) Patent No.: US 8,317,267 B2
(45) Date of Patent: Nov. 27, 2012

(54) ERGONOMIC SADDLE CHAIR

(76) Inventor: Jay Stuart Wallace, Renton, WA (US)

( * ) Notice: Subject to any disclaimer, the term of this patent is extended or adjusted under 35 U.S.C. 154(b) by 215 days.

(21) Appl. No.: 12/835,929

(22) Filed: Jul. 14, 2010

(65) Prior Publication Data

US 2011/0012397 A1 Jan. 20, 2011

Related U.S. Application Data

(60) Provisional application No. 61/271,325, filed on Jul. 20, 2009.

(51) Int. Cl.
*A47C 7/50* (2006.01)
*A47C 7/52* (2006.01)

(52) U.S. Cl. ..... 297/423.12; 297/195.11; 297/201; 297/423.11

(58) Field of Classification Search ..... 297/195.11, 297/201, 300.7, 312, 423.11, 423.12
See application file for complete search history.

(56) References Cited

U.S. PATENT DOCUMENTS

| | | | | | |
|---|---|---|---|---|---|
| 3,541,313 | A | * | 11/1970 | Buzzi | 297/195.11 |
| 3,669,493 | A | | 6/1972 | Vowles | |
| 3,754,787 | A | * | 8/1973 | Garber | 297/195.11 |
| RE28,038 | E | * | 6/1974 | Buzzi | 297/195.11 |
| 4,328,991 | A | | 5/1982 | Mengshoel | |
| 4,564,237 | A | | 1/1986 | Steifensand | |
| 4,589,699 | A | | 5/1986 | Dungan | |
| 4,607,882 | A | * | 8/1986 | Opsvik | 297/195.11 |
| 4,793,655 | A | | 12/1988 | Kvalheim | |
| 4,832,407 | A | | 5/1989 | Serber | |
| 4,848,841 | A | | 7/1989 | Giselsson | |
| 4,852,942 | A | * | 8/1989 | York | 297/195.11 |
| 5,186,519 | A | * | 2/1993 | Larson | 297/423.12 |
| 5,251,961 | A | | 10/1993 | Pass | |
| 5,401,078 | A | * | 3/1995 | Riach | 297/423.11 |
| 5,490,716 | A | * | 2/1996 | Naughton | 297/423.12 |
| 5,577,800 | A | | 11/1996 | Earl | |
| 5,667,278 | A | | 9/1997 | Li | |
| 5,669,669 | A | | 9/1997 | Usher | |
| 5,782,534 | A | | 7/1998 | Desanta | |
| 5,857,747 | A | | 1/1999 | Mundkowski | |
| 6,065,808 | A | * | 5/2000 | Tinsley | 297/423.11 |
| 6,543,853 | B1 | * | 4/2003 | Splane, Jr. | 297/423.12 |
| 6,698,831 | B2 | * | 3/2004 | Lloyd | 297/195.11 |
| 6,709,052 | B2 | | 3/2004 | Jalkanen | |
| 6,726,276 | B1 | | 4/2004 | Tholkes | |
| 6,805,322 | B2 | | 10/2004 | Schmidt | |
| 6,811,225 | B1 | | 11/2004 | Konya | |
| 6,827,401 | B2 | | 12/2004 | Marshall | |
| 7,070,241 | B2 | * | 7/2006 | Saulnier et al. | 297/423.12 |
| 7,144,080 | B2 | * | 12/2006 | Lloyd | 297/195.11 |
| 7,306,289 | B2 | * | 12/2007 | Kobayashi | 297/423.12 |
| 7,367,623 | B2 | | 5/2008 | Tholkes | |
| 7,632,191 | B2 | * | 12/2009 | Zambelli et al. | 472/43 |
| 2003/0218370 | A1 | * | 11/2003 | Langham | 297/344.22 |
| 2007/0052275 | A1 | * | 3/2007 | Ghilzai | 297/423.12 |
| 2007/0063569 | A1 | | 3/2007 | Mays | |
| 2009/0140567 | A1 | * | 6/2009 | Weiss | 297/423.12 |

* cited by examiner

*Primary Examiner* — Rodney B White

(57) ABSTRACT

An ergonomic chair comprising a saddle seat, frame, and shin supports that are adjustable in position and orientation with respect to the saddle seat. The saddle seat is adjustable in terms of the width of the portion of the seat supporting the user's thighs. The shin supports are adjustable with respect to the position of the saddle seat in three degrees of freedom and freely rotate in a fourth degree of freedom. In one embodiment, the frame comprises a rocking mechanism allowing the seat to rock forward and back.

10 Claims, 6 Drawing Sheets

ERGONOMIC SADDLE CHAIR

RELATED APPLICATIONS

This application claims benefit of U.S. Provisional Patent Application No. 61/271,325, entitled "Adjustable Ergonomic Seat," by Jay Stuart Wallace, filed Jul. 20, 2009, which is incorporated by reference herein.

BACKGROUND

In the modern workplace, many workers spend many hours at a desk or work surface in a seated position. Even with occasional breaks or periods away from the work area, spending several hours each day in the same or similar seated work position often leaves the worker with muscle and joint pain, especially lower back pain. It has become vital to the health and well being of workers that seating is provided for the work environment that promotes health, comfort, and ergonomics. Comfortable, ergonomic seating is of great importance to minimize the physical stresses associated with today's workplace.

In general, the present state of the art is incapable of providing users with the option to switch to different comfortable, healthy postures while keeping them within an ergonomic range of a work station in a manner that is non-disruptive to the task being performed. Particularly, the current state of the art does not provide an active sitting and proactive positioning system which incorporates the support of the various body parts and promotes healthy postures and comfort at work stations.

Numerous attempts have been made to provide seating devices that allow for adjustment of the user's position and distribute support of the user's weight across the buttocks, knees, shins, and back. There are three key features of any ergonomic seating system. First, ease of adjustability prior to use in order to fit users of various sizes. Second, adjustment of the seat bottom and other supports during use to relieve stress and engage different muscle groups. Third, the seating system preferably should allow flexible, natural movement during use to allow the user's upper body to orient to the work at hand and to allow the user's lower body to shift and stretch as desired. Information relevant to prior attempts to address these problems can be found in U.S. Pat. Nos. 3,541,313; 3,669,493; 4,589,699; 4,793,655; 4,832,407; 4,960,305; 5,667,278; 5,669,669; 5,782,534; and 7,367,623. However, each of these references either fails to allow user to shift weight to the user's thighs or fails to allow adequate adjustment of relative position and orientation between a seat bottom and a knee or shin support. For the foregoing reasons, there is a need for a seating system that a user can adjust to shift weight from the user's posterior to the user's shins and thighs in order to increase comfort and relieve stress.

SUMMARY

The present invention is based on previously unrealized objectives to successfully integrate the needs of worker productivity with comfort and health. Specifically, in the preferred embodiment, the invention implements principles of active sitting and proactive positioning in which the user of the chair is enabled and encouraged to change to various comfort and health postures while maintaining ergonomically compatible access and reach to a work station at all times.

The present invention is directed to a saddle chair that satisfies these needs for adjustability both prior to use to accommodate a user's size as well as during use to alter the user's weight distribution between the user's buttocks, thighs and shins, while allowing flexible movement of the user's upper body during use. A saddle chair having features of the present invention has a saddle-shaped seat and position-adjustable shin supports. The shin supports are positioned below the apex of the seat in a comfortable position to receive the user's knees or shins. The position of the shin supports relative to the seat are adjustable both laterally and vertically relative to the seat in order to provide a comfortable fit for the user.

An ergonomic chair having features of the present invention includes a saddle seat having a plurality of shin support mount points on each side, in one exemplary embodiment, these mount points are holes in the surface of the saddle seat shaped to accept a pin on the shin support and allow it to pivot in the hole. Because there are several mount points on each side of the saddle seat, each shin support may be mounted in one of several mount points. Much like a pegboard for securing items to a wall with hooks, each mount point hole provides a different relative position between the shin support and the saddle seat. The saddle seat also includes a means for adjusting the width of the seat for purposes of providing the user suitable adjustment for comfort as well as dynamic adjustment of weight distribution between the user's buttocks, thighs and shins. In a preferred embodiment, the ergonomic chair also includes a spring-loaded pivoting joint in the chair frame that allows the user to rock the saddle seat forward and back. The setting of a knob allows the user to lock or unlock the pivoting joint and thus enable or disable the rocking motion that is provided by the spring-loaded pivoting joint and a second knob permits adjustment of a damping mechanism.

DESCRIPTION OF THE DRAWINGS

The present invention will become more fully understood from the following description, appended claims, and the accompanying drawings where:

DESCRIPTION

Definitions

A "saddle seat" is an object designed and intended to support a person in a sitting position where a portion of the seat extends between the person's thighs or knees when the person sits on the "saddle seat" and where the person's weight is not solely supported by the person's buttocks but also by the person's thighs. Examples of a "saddle seat" include: a motorcycle seat, a saddle used on a horse, and the seats depicted in U.S. Pat. Nos. 3,541,313 and 6,709,052.

A "shin support" is a structure suitable for use to support a person's leg between the knee and ankle, inclusive.

Overview

Figure 1:
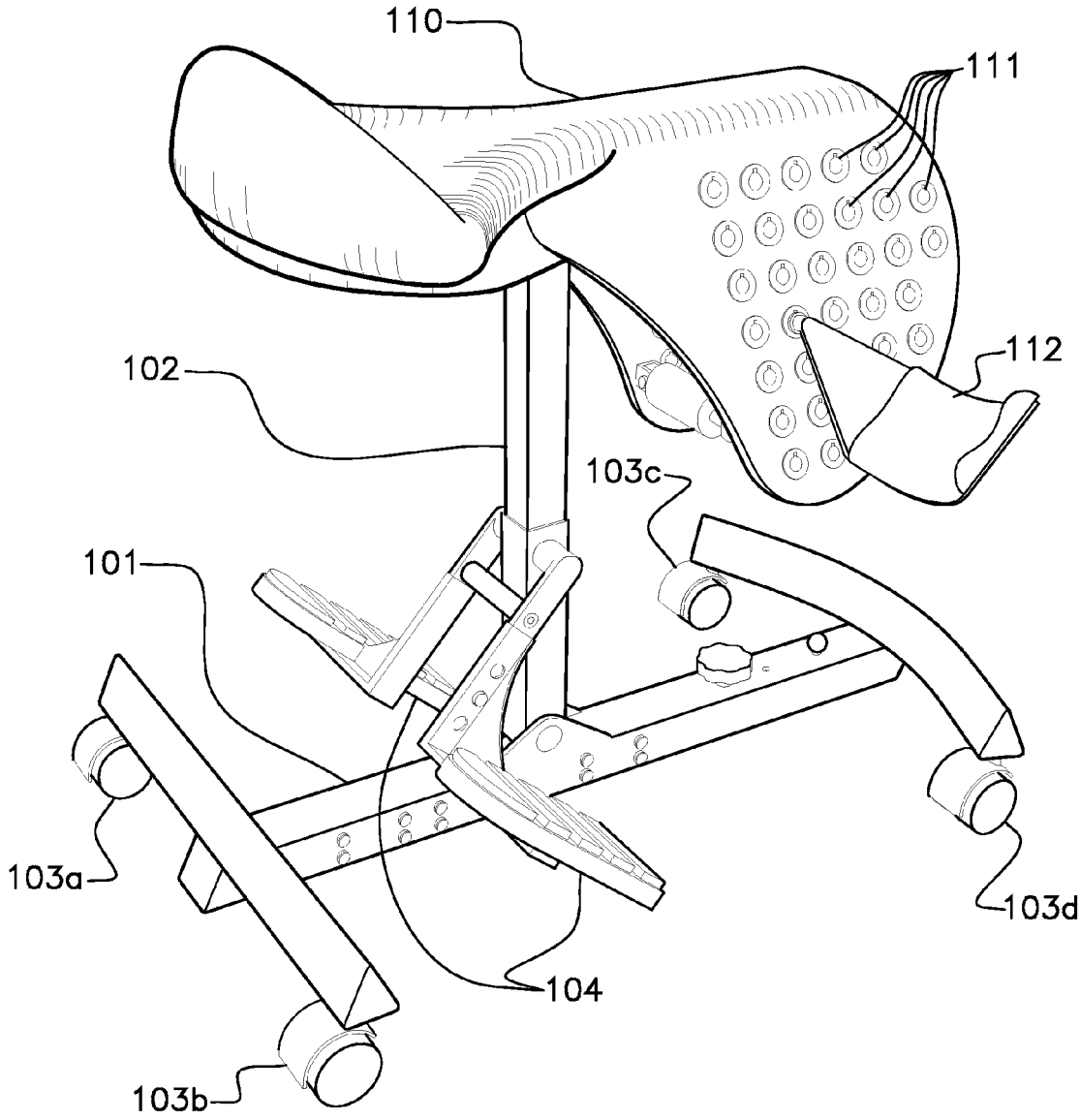
FIG. 1 is a perspective view of a saddle chair in accordance with the principles of the present invention.
Figure 2:
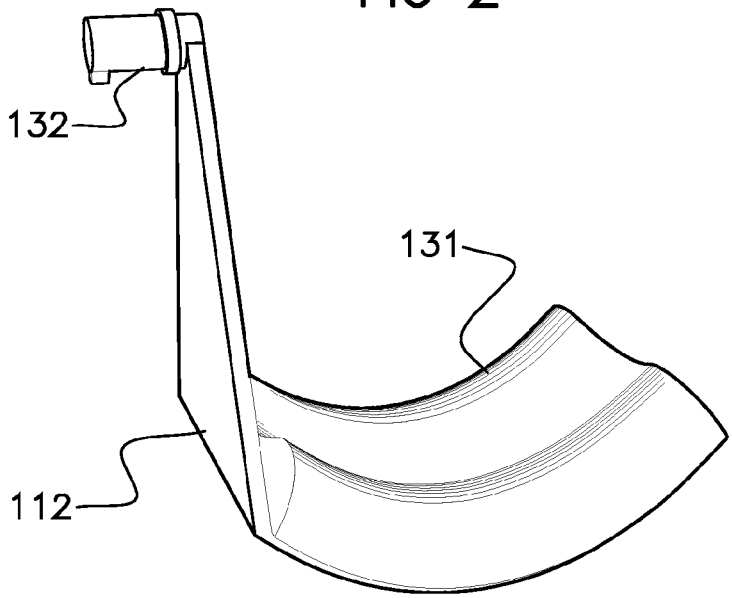
FIG. 2 is a perspective view of a shin support of the saddle chair of FIG. 1.

As shown in FIGS. 1-4, a saddle chair embodying features of the present invention comprises a base frame 101, a saddle seat 110 attached the base frame 101, a first and second shin support 112 attached to the saddle seat 110 at a first and second shin support mount point 111, and a plurality of alternate mounting points 111 where the first and second shin supports 112 may be mounted so as to provide a plurality of relative positions between the saddle seat 110 and the first and second shin supports 112. As shown in FIG. 2, a preferred embodiment of a saddle chair incorporating features of the present invention includes a means for adjusting the width of the saddle seat so as to provide easy adjustment of a seated person's position and weight distribution.

Detailed Description of the Invention

Referring to FIG. 1, there is shown a perspective view of a saddle chair embodying features of the present invention. A base frame 101 comprises a support post 102 and casters 103*a*, 103*b*, 103*c*, and 103*d*. Optional foot supports 104 are shown attached to the support post 102 but may be attached to any appropriate area of the base frame 101. A saddle seat 110 is attached to the base frame 101. The saddle seat 110 comprises a plurality of mount points 111 suitable for attachment of a shin support 112. A shin support 112 is shown attached to the saddle seat 110 at one of a plurality of shin support mount points 111. In the preferred embodiment of FIG. 1, said plurality of mount points 111 are holes through the surface of saddle seat 110, which holes are substantially round in shape and include a keyway groove.

Figure 4:
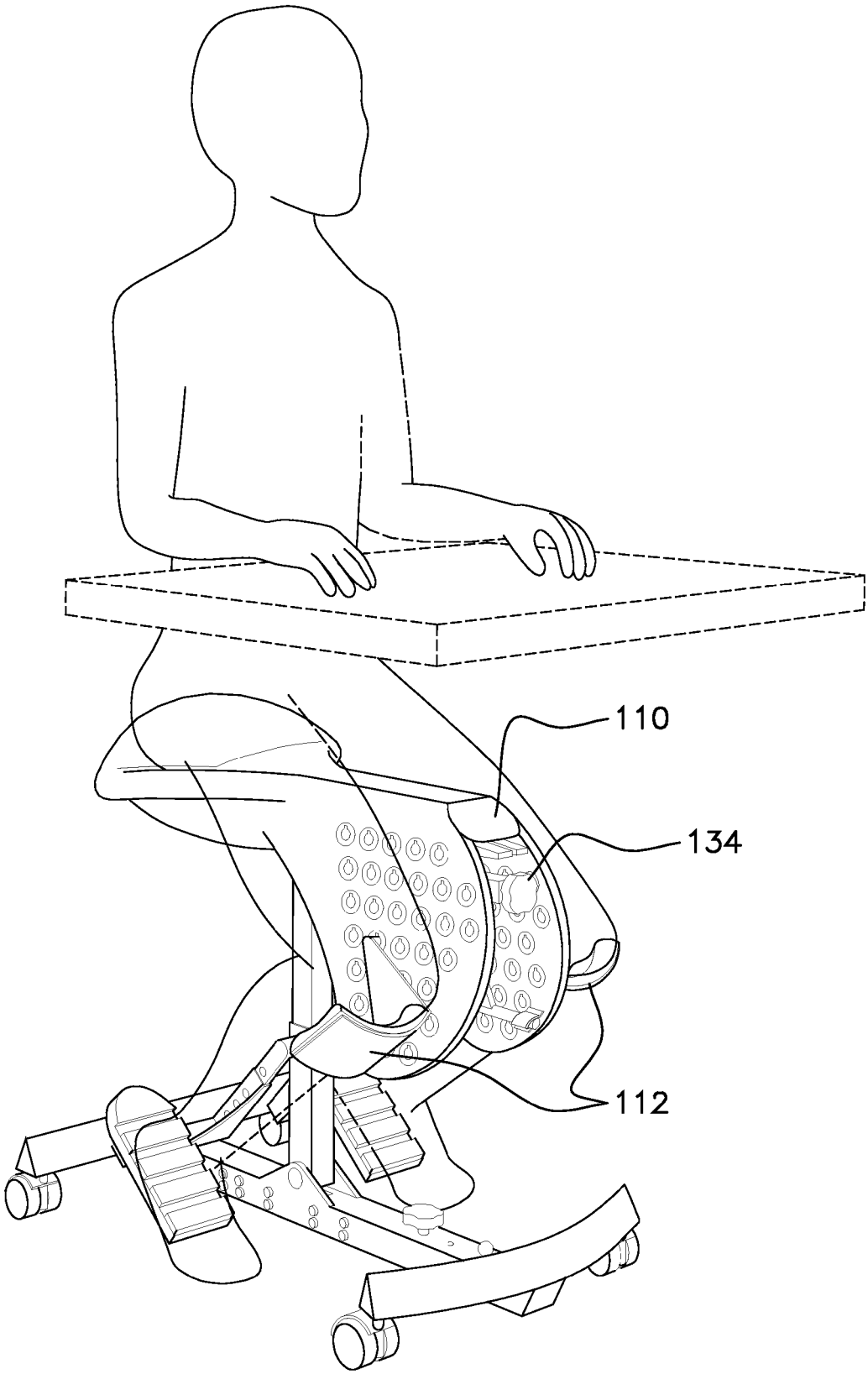
FIG. 4 is a perspective view of the chair of FIG. 1 being used by a person in an office environment.

Referring to FIG. 2, a shin support 112 is shown in perspective. When a person is seated in the chair of FIG. 1, the person's shins rest in the curved and preferably padded shin stirrup 131. Depending on a person's physical characteristics and how the chair has been adjusted, the shin supports may support the person's knee, ankle, or any portion of the shin or leg between the knee and ankle. A typical configuration for a seated person on a saddle chair having features of the present invention is also shown in FIG. 4. Shin support 112 is attached to saddle seat 110 by inserting shin support pin 132 into one of plurality of mount points 111. Shin support pin 132 may be a detent pin of one of the types commonly available, such as the pin disclosed in U.S. Pat. No. 6,872,039.

Figure 2A:
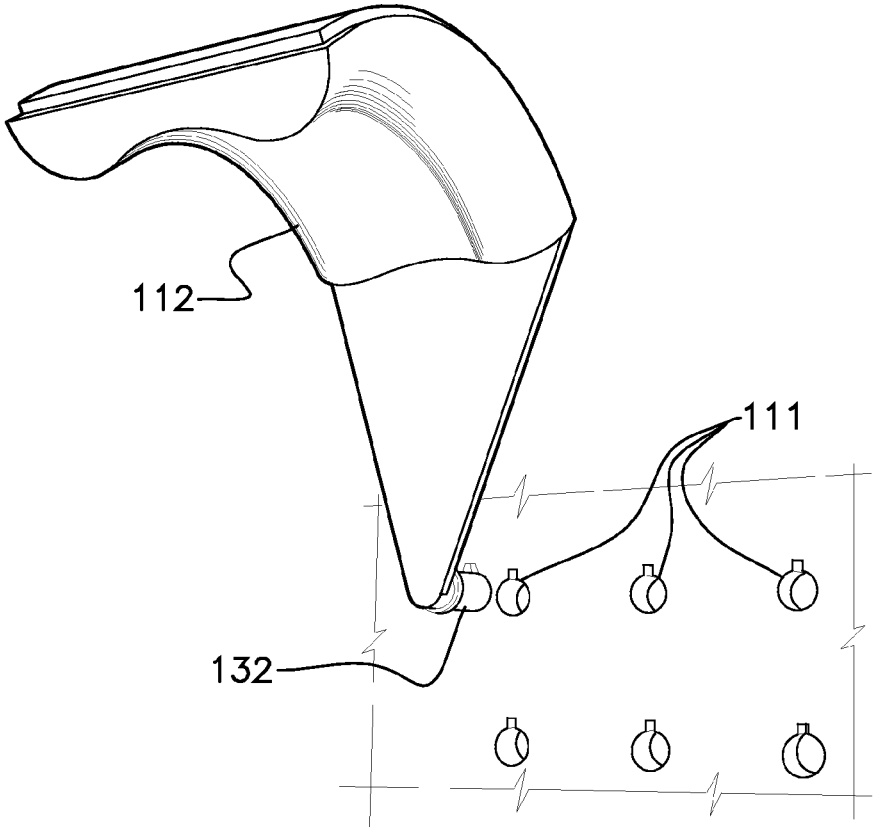
FIG. 2*a* is a perspective view of the shin support and mount points of the saddle chair of FIG. 1.

A variety of mechanisms suitable for pivotable mount points 111 and compatible pins 132 are known in the art and any of these would be suitable for use in the present invention, including but not limited to the following three described options. First, a cotter key where the cotter key is inserted through the rotating pin 132 on the opposite side of the shin support 112. Second, a threaded knob may be to the hold an inserted pin 132 in place while permitting the pin 132 to rotate. A third, preferred option is as shown in FIGS. 2 and 2*a*: a keyway system where the shin support pin 132 is round with a short lengthened key blade on the tip of the pin 132 that must be inserted into the receiving mount point holes 111 which are circular with a keyway groove at the top to receive the blade on the shin support pin 132. The key blade and keyway would be oriented such that the shin support 112 must be rotated upside down in order to insert the pin 132 into the selected mount point 111. Then after the blade passes through the mount point hole 111, as the pin 132 is fully inserted, the shin support 112 can be rotated back down and pivots in its normal operating range.

Figure 2B:
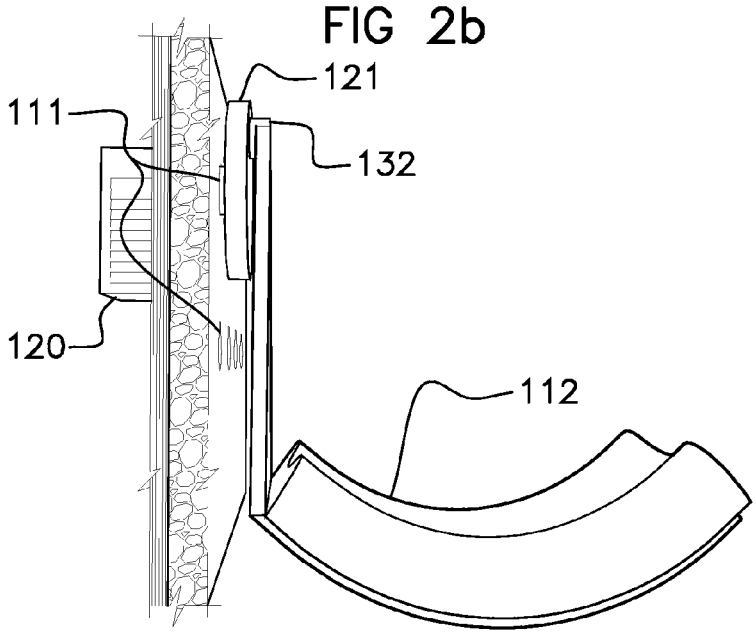
FIG. 2*b* is a perspective view of an alternate implementation of the shin support and mount points of the saddle chair of FIG. 1.

In FIG. 2*b* is shown an alternative embodiment of the shin support 112 of FIG. 2. A shin support 112 is attached to the saddle seat 110 at a mount point 111. A motor 120 is mounted on the inner surface of the saddle seat 110 and aligned with the same mount point 111 in which the shin support 112 is mounted. In this embodiment, the shin support pin 132 is inserted into offset plate 121, which provides an offset, rotatable connection to the motor 120 at mount point 111. The operation of the motor-driven shin support 112 is similar to a common BBQ rotisserie unit. The motor's 120 rotation speed is adjustable, and when operating it rotates the offset plate 121 which in turn moves the shin support pin 132 in a circular motion analogous to the movement of a carriage on a Ferris wheel. The user's shins are slowly moved in a circular motion up, down, forward and back within the small range of the offset plate 121. This motion facilitates a constant readjustment of the user's seating position, allowing greater comfort over extended periods of time in the seated position.

In the embodiment of FIG. 1, shin supports 112 are shown attached directly to saddle seat 110. An advantage of this arrangement is that a single means for adjusting the width of the saddle seat 110 also functions to adjust the distance between the shin supports 112. This direct attachment is not required to practice the present invention, however. The shin supports 112 may also be attached to the base frame 101 such as to the support post 102, provided their position is near the lower portion of the saddle seat 110 and oriented appropriately to accept a seated user's shins. The adjustment of the width of the saddle seat 110 as well as the distance between the shin supports 112 functions to transfer some of the user's weight from the user's buttocks to his thighs or shins. The wider the adjustment of the saddle seat 110, the more weight is borne by the user's thighs and shins and the less is borne by the user's buttocks.

Figure 3:
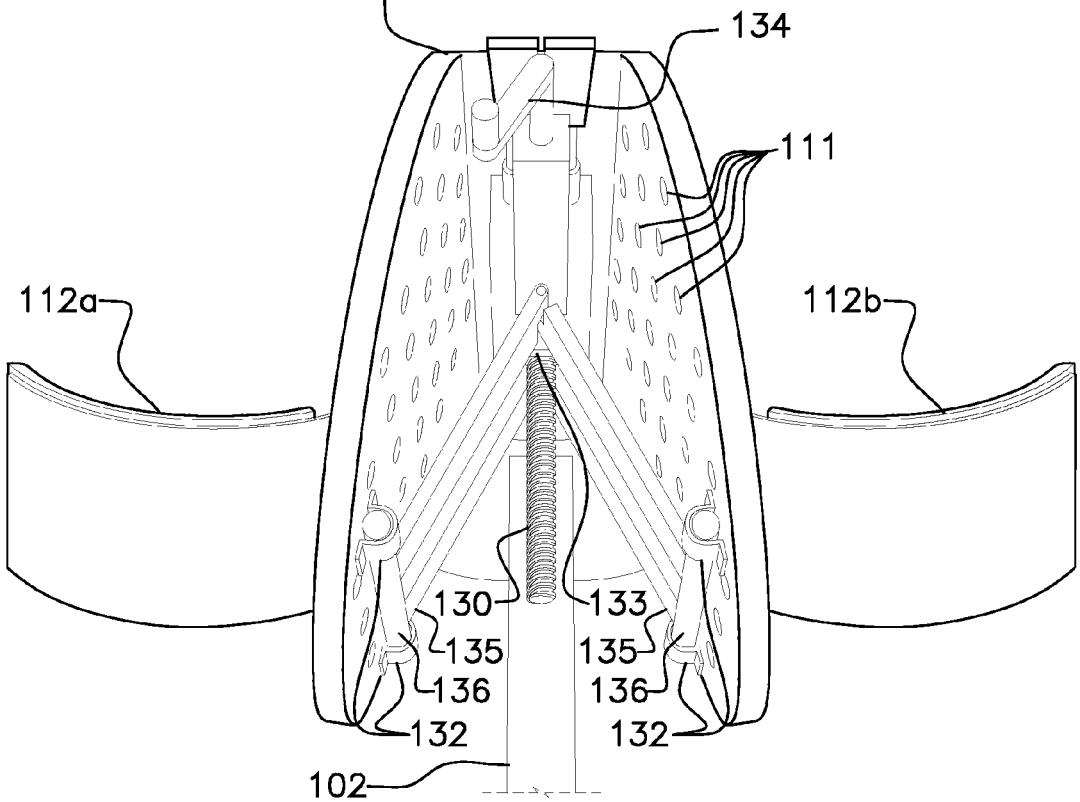
FIG. 3 is a perspective view of a means for adjusting the width of said saddle seat of the saddle chair of FIG. 1.

Referring to FIG. 3, there is shown a lower front view of the saddle chair of FIG. 1. A preferred embodiment of a means for adjusting the width of said saddle seat is shown as the combination of structures threaded shaft 130, push bars 135, spreader bars 136, brackets 132, and threaded cylinder 133. The brackets 132 allow rotation of the spreader bars 136 while holding them against the sides of saddle seat 110. In this embodiment, said means for adjusting the width of said saddle seat 110 is operated by turning a manual crank 134 to rotate threaded shaft 130, thereby driving threaded cylinder 133 down threaded shaft 130, which causes push bars 135 to force the sides of saddle seat 110 outward thus increasing the width of said saddle seat 110. To narrow the width of saddle seat 110, threaded shaft 130 is turned the opposite direction, driving threaded cylinder 133 up threaded shaft 130, which causes push bars 135 to pull the sides of saddle seat 110 inward thus decreasing the width of saddle seat 110. In alternative embodiments, the width adjustment caused by operation of crank 134 may be adjusted by activation of a motor, a ratcheting lever, or other suitable means known in the art.

The present invention is not limited to the particular implementation of the means for adjusting the width of a saddle seat shown in FIG. 3. Any suitable structure or mechanism for effectuating adjustment of the distance between the two sides of saddle seat 110 may be used to selectively adjust the distance between the sides of the saddle seat 110 and also between the shin supports 112. Other suitable structures known in the art include the following examples.

Figure 3A:
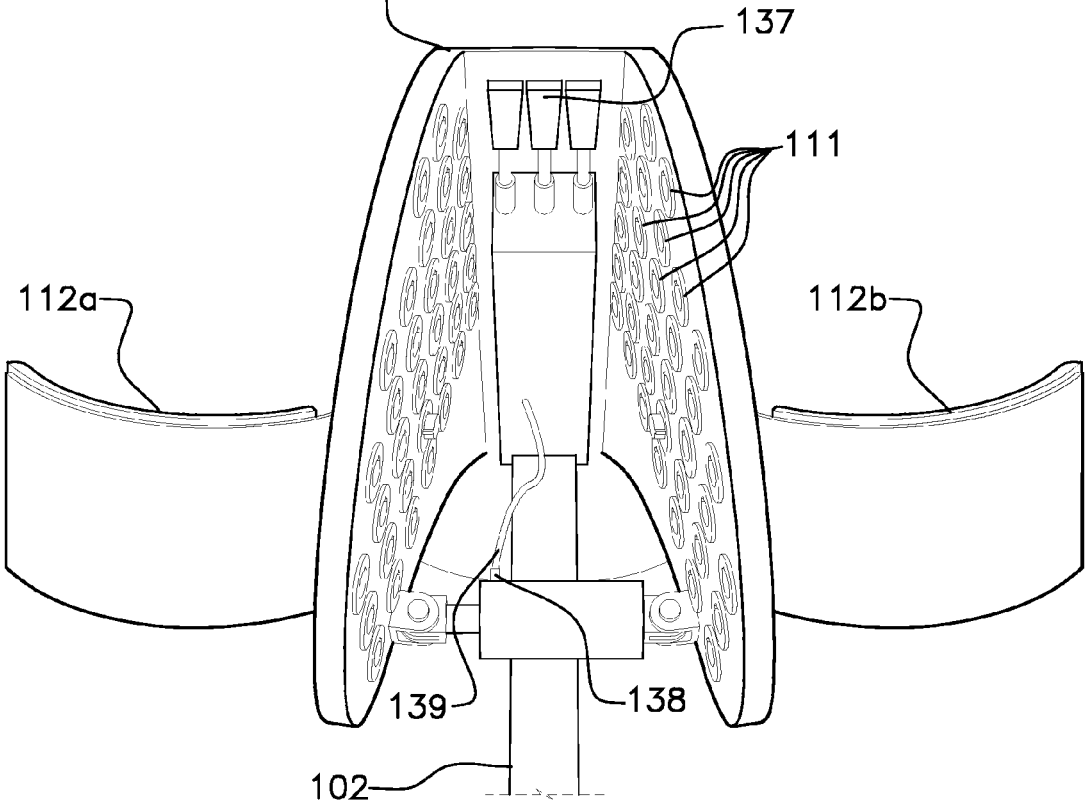
FIG. 3*a* is a perspective view of an alternate implementation of the means for adjusting the width of said saddle seat of the saddle chair of FIG. 1.

A first example is a horizontal, spring loaded, telescoping, pneumatic piston with an air release button activated by a lever arm similar to those in a typical office chair height adjustment systems as shown in FIG. 3*a*. To adjust the sides, the user activates a lever arm 137 that presses the air release button on the pneumatic piston 138 by means of a cable system 139 and either squeezes his or her thighs together or allows the spring within the piston to push the sides apart until the correct width is achieved and then releases the lever. An example gas cylinder suitable for use on a chair having features of the present invention is described in U.S. Pat. No. 4,200,332. A second example is a pair of horizontal, geared arms attached one to each side of the saddle seat 110. The arms completely overlap one another when the seat sides are down. The two arms pass through a locking mechanism located at the center of the seat between the two arms. A central gear within the locking mechanism engages both arms ensuring that each seat side is deployed in and out the same distance. The locking mechanism is released to adjust the seat sides in and out. When unlocked, the user can move the sides of the saddle seat 110 closer together or further apart as their shins are engaged in the shin supports 112, then lock the sides in any desired setting within their range of movement. A third example is a horizontal, spring loaded, telescoping post with one end attached to each side of the saddle seat so as to push the sides of the seat apart. A user may push against the spring loaded action with the user's thighs in order to narrow the seat. When the seat is compressed to the desired width, the user can lock the spring loaded post into the selected position by operating a locking device to restrict the movement of said spring loaded post. A fourth option is to use an electric motor to drive the saddle seat side expanding arms. The desired width of the saddle seat 110 may be set by operation of the motor, which may further be set to cycle the width between a desired minimum and maximum setting.

FIG. 4 is a representative depiction of the chair of FIG. 1 while in use by a typical user. As shown in FIG. 4, the user's upper shins just below the knees are resting in the shin supports 112. The crank 134 is positioned between the user's knees and is easily reachable by the user to dynamically adjust the width of the saddle seat 110 and thereby also the distance between the shin supports 112.

Figure 5:
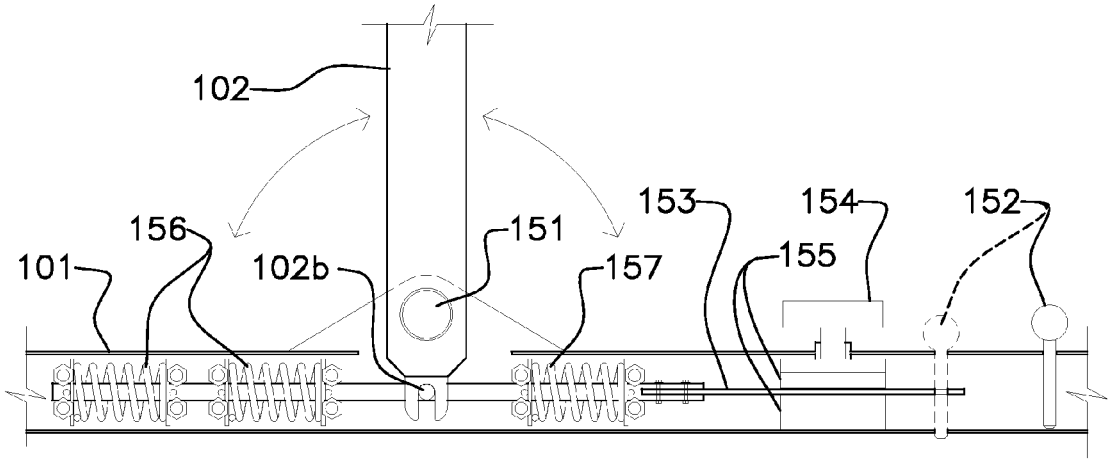
FIG. 5 is a cutaway view of the base frame of the chair of FIG. 1.
Figure 6:
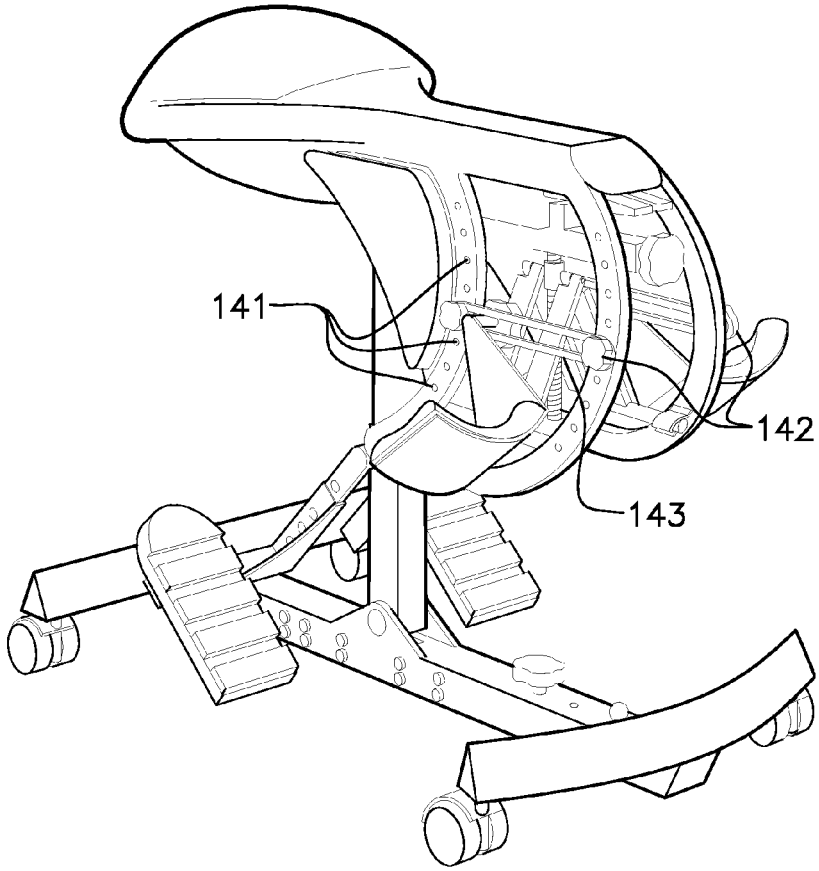
FIG. 6 is a perspective view of an embodiment of a saddle chair in accordance with the principles of the present invention having an alternative shin support mount frame.

Referring now to FIG. 5, vertical support post 102 is mounted to the base frame 101 by means of a pivoting connection 151. The vertical support post 102 on which a saddle seat 110 is mounted may rock forward and back on the pivoting connection 151 as shown by the arrows. When vertical support post 102 is rocked forward and back by a person seated on a seat mounted to the upper end of said support post 102, the lower end 102*b* of support post 102 drives shaft 153 alternately against rear springs 156 and forward spring 157. An adjustment knob 154 is positioned on the forward section of the base frame 101 along side a pin-knob 152. The adjustment knob 154 is used to adjust the friction damping force imparted on the shaft 153 by friction plates 155. The less resistance that is imparted on the shaft 153 by the adjustment knob 154, the more freely the support post 102 is permitted to rock forward and back. The pin-knob 152 shown dashed, may be placed in the position indicated to block movement of shaft 153 and thereby prevent the vertical support post 102 from rocking. The pin-knob 152 may be placed in a stored position as shown to permit free movement of shaft 153 and thereby to enable rocking of vertical support post 102.

In operation, the ergonomic chair may be adapted to support a seated user in a substantially neutral position in which the user's weight is supported by the user's buttocks, thighs, and shins. The ergonomic seat may be adjusted for fit to users of different physical sizes by adjusting the position of the shin supports relative to the saddle seat. Due to its saddle seat design, the ergonomic chair is easily mounted in comparison to previously known chairs designed to support the user's weight on the user's knees or shins. When seated on the ergonomic chair, the user is free to shift his weight by rocking forward and back about the pivot means in the chair frame against the rocker springs. This gentle rocking motion engages the user's abdominal core muscles and serves to reduce muscle tension and fatigue. The width of the saddle seat is also adjustable while in use to enable the user to dynamically adjust the distribution of weight from the buttocks to the thighs and knees. As one muscle group tires, another muscle group can be engaged by adjusting the seat width. As the seat is widened, more of the user's weight is borne by the thighs and shins and less by the buttocks. Conversely, as the seat is narrowed more weight is shifted to the buttocks.

Various modifications, substitutions, and changes may be made in the structure and embodiments shown without departing from the concept of the invention. Therefore, the scope of the appended claims should not be limited to the description of the preferred versions set forth above.

What is claimed is:

1. An ergonomic chair comprising a saddle seat with sides, shin supports and a mechanism configured for selectively adjusting distance between the sides of said saddle seat and between said shin supports wherein said chair permits a user having a weight to adjust the relative positions of said shin supports and said saddle seat sides to selectively distribute said user's weight between said user's buttocks, thighs and shins.

2. The ergonomic chair of claim 1, wherein said relative positions of said shin supports and said saddle seat are adjustable in three degrees of freedom of displacement and said shin supports are self-adjusting in one degree of freedom of rotation.

3. The ergonomic chair of claim 1, further comprising:

(a) a frame;

(b) a pivoting means connecting said saddle seat to said frame for enabling said seat with sides and shin supports to move in a rocking motion about a substantially horizontal axis, and (c) spring means for biasing the position of said saddle seat with sides and shin supports to a neutral position while permitting a user-initiated rocking motion.

4. The ergonomic chair of claim 3, further comprising means for adjusting a spring force imparted by said spring means.

5. An ergonomic chair for providing a user-selectable distribution of weight between a user's buttocks, thighs, and shins, said chair comprising:

(a) a saddle seat comprising a plurality of shin support mount points;

(b) a first shin support pivotally attached to a first side of said saddle seat at a first shin support mount point; and (c) a second shin support pivotally attached to a second side of said saddle seat at a second shin support mount point;

whereby the position of said first and second shin support members relative to said saddle seat may be adjusted by selecting said first and second shin support mount points from among the plurality of shin support mount points.

6. The ergonomic chair of claim 5 wherein said saddle seat further comprises a means for adjusting the width of said saddle seat.

7. The ergonomic chair of claim 5 wherein said chair comprises (a) a pivoting means connected to said saddle seat for rocking said saddle seat about a substantially horizontal axis, and (b) a spring means for biasing the position of said saddle seat to a neutral position while permitting a user-initiated rocking motion.

8. The ergonomic chair of claim 5 wherein said first shin support is connected to said first shin support mount point by a first offset plate and said second shin support is connected to said second shin support mount point by a second offset plate, further comprising:

(a) a first motor connected to said first offset plate and operable to selectively rotate said first offset plate and thereby impart a circular motion to said first shin support; and (b) a second motor connected to said second offset plate and operable to selectively rotate said second offset plate and thereby impart a circular motion to said second shin support.

9. An ergonomic chair for providing a user-selectable distribution of weight between a user's buttocks, thighs, and shins, said chair comprising:

(a) a saddle seat comprising a first and second shin support mount frame, each of said first and second shin support mount frames comprising a means for adjusting the position of a shin support in two orthogonal directions;

(b) a first shin support pivotally attached to said first shin support mount frame; and (c) a second shin support pivotally attached to said second shin support mount frame;

whereby the distribution of a user's weight across the user's buttocks, thighs, and shins may be altered by adjusting the position of said first and second shin supports using said first and second shin support mount frames;

wherein said saddle seat comprises a means for adjusting the width of said saddle seat.

10. An ergonomic chair for providing a user-selectable distribution of weight between a user's buttocks, thighs, and shins, said chair comprising:

(a) a saddle seat comprising a first and second shin support mount frame, each of said first and second shin support mount frames comprising a means for adjusting the position of a shin support in two orthogonal directions;

(b) a first shin support pivotally attached to said first shin support mount frame; and (c) a second shin support pivotally attached to said second shin support mount frame;

whereby the distribution of a user's weight across the user's buttocks, thighs, and shins may be altered by adjusting the position of said first and second shin supports using said first and second shin support mount frames;

wherein said chair comprises (a) a pivoting means connected to said saddle seat for rocking said saddle seat about a substantially horizontal axis, and (b) a spring means for biasing the position of said saddle seat to a neutral position while permitting a user-initiated rocking motion.

* * * * *